US006748924B2

(12) United States Patent
Yu

(10) Patent No.: US 6,748,924 B2
(45) Date of Patent: Jun. 15, 2004

(54) METHOD AND SYSTEM FOR CONTROLLING FUEL INJECTION

(75) Inventor: Chul-Ho Yu, Seoul (KR)

(73) Assignee: Hyundai Motor Company, Seoul (KR)

( * ) Notice: Subject to any disclaimer, the term of this patent is extended or adjusted under 35 U.S.C. 154(b) by 68 days.

(21) Appl. No.: 10/174,068

(22) Filed: Jun. 17, 2002

(65) Prior Publication Data

US 2003/0051709 A1 Mar. 20, 2003

(30) Foreign Application Priority Data

Sep. 18, 2001 (KR) ..... 2001-0057501
Feb. 22, 2002 (KR) ..... 2002-0009519

(51) Int. Cl.[7] ..... F02M 37/04

(52) U.S. Cl. ..... 123/458; 123/457; 123/463; 123/446

(58) Field of Search ..... 123/457, 458, 123/446, 463, 179.16, 179.17

(56) References Cited

U.S. PATENT DOCUMENTS 5,598,817 A * 2/1997 Igarashi et al. ..... 123/456
5,731,515 A * 3/1998 Tominaga et al. ..... 123/446
5,911,208 A * 6/1999 Furusawa et al. ..... 123/506
6,135,090 A * 10/2000 Kawachi et al. ..... 123/446
6,279,532 B1 * 8/2001 Takano et al. ..... 123/357
6,378,501 B1 * 4/2002 Hisato et al. ..... 123/458
2003/0154959 A1 * 8/2003 Rembold et al. ..... 123/458

* cited by examiner

*Primary Examiner*—Thomas N. Moulis
(74) *Attorney, Agent, or Firm*—Morgan Lewis & Bockius LLP

(57) ABSTRACT

A fuel injection control method using a system comprising a high-pressure pump for pumping fuel, a fuel-pressure control valve disposed in a fuel bypass line communicating an output port and an input port of said high-pressure pump, and a controller for regulating fuel pressure, is provided. The method comprises: monitoring engine operating conditions; determining an optimal fuel injection pressure on the basis of said monitored engine operating conditions; determining on/off timing and on/off duration of said fuel-pressure control valve such that fuel pressure inside a fuel rail approaches said optimal fuel injection pressure; and opening and closing said fuel-pressure control valve according to said determined on/off timing and on/off duration of said fuel-pressure control valve.

11 Claims, 2 Drawing Sheets

METHOD AND SYSTEM FOR CONTROLLING FUEL INJECTION

FIELD OF THE INVENTION

The present invention relates to a fuel injection control method and a system thereof, and more particularly, to a fuel injection pressure control method and system for reducing an unnecessary power loss of an engine by controlling an output pressure of a high-pressure pump.

BACKGROUND OF THE INVENTION

Generally, a compression ignition engine is provided with a fuel injection control system for controlling the pressure of injected fuel. Also, a gasoline direct injection (GDI) engine is provided with a fuel injection control system.

As shown in FIG. 3, a fuel injection control system may include a fuel rail 103 to which a plurality of fuel injectors are connected, a high-pressure pump 101 for pumping fuel into the fuel rail 103, a fuel pressure sensor 109 for detecting pressure of fuel inside the fuel rail 103, and a fuel-pressure control valve 107 for controlling pressure of fuel. The fuel-pressure control valve 107 is mounted to the fuel rail 103. An engine control unit (hereinafter referred to as an ECU) generates a fuel return signal for returning some portion of fuel of the fuel rail 103 to the high-pressure pump 101.

If the fuel-pressure control valve 107 is operated according to the fuel return signal, some portion of fuel of the fuel rail 103 returns to the high-pressure pump 101 so that pressure of fuel injected from the fuel injector 105 is regulated.

In the fuel injection control system according to the prior art, the high-pressure pump 101 pressurizes fuel without regard for an amount of fuel injected from the fuel injector 105, and the fuel-pressure control valve 107 returns some portion of fuel being pressurized by the high-pressure pump 101 to the high-pressure pump 101. Therefore, a high load on the output port of the high-pressure pump 101 is maintained. As a result, an engine loss for operating the high-pressure pump 101 is increased.

SUMMARY OF THE INVENTION

The present invention provides a fuel injection control system for controlling an output pressure of an output port of a high-pressure fuel pump on the basis of operating conditions of a vehicle such that engine power loss caused by an unnecessary operation of the high-pressure pump is reduced in order to increase fuel economy.

In a preferred embodiment of the present invention, a fuel rail to which a plurality of fuel injectors are connected is provided. A high-pressure pump pressurizes fuel and provides the pressurized fuel to the fuel rail. A check valve is disposed between the high-pressure pump and the fuel rail. The check valve leads fuel to flow from the high-pressure pump to the fuel rail. A fuel-pressure control valve is disposed in a fuel bypass line communicating between an output port of the high-pressure pump and an input port of the high-pressure pump. The fuel-pressure control valve selectively opens and closes the fuel bypass line. A controller is also provided for opening and closing operation of the fuel-pressure control valve on the basis of fuel injection timing, an amount of fuel injected and a delay time of the fuel-pressure control valve such that fuel pressure inside said fuel rail approaches an optimal fuel pressure.

Preferably, the fuel pressure inside the fuel rail is detected by a pressure sensor that is mounted to the fuel rail. The optimal fuel pressure is calculated by the controller on the basis of engine speed and engine load.

In a further preferred embodiment, a fuel line is adapted to provide pressurized fuel to a fuel rail supporting fuel injectors. A fuel pump having an input and an output is disposed in the fuel line. A check valve is disposed in the fuel line down stream from the pump. A bypass line communicates between the pump output and input. A fuel-pressure control valve is disposed in the bypass line. The pressure is controlled by a control unit communicating with the fuel-pressure control valve. The control unit generates a signal for selectively opening or closing the fuel-pressure control valve based on fuel injection timing, an amount of fuel injected and a delay time of the fuel-pressure control valve such that fuel pressure inside the fuel rail approaches an optimal fuel pressure. Preferably, the system further comprises an engine speed sensor and a engine load sensor communicating with the control unit. The control unit thus calculates the optimal fuel pressure based on input from the sensors.

In another preferred embodiment of the present invention, a fuel injection control method comprises a number of steps, including monitoring engine operating conditions and determining various parameters. For example, an optimal fuel injection pressure may be determined on the basis of the monitored engine operating conditions. Also, on/off timing and on/off duration of the fuel-pressure control valve may be determined such that fuel pressure inside a fuel rail approaches optimal fuel injection pressure. The fuel-pressure control valve may then be opened and closed according to the determined on/off timing and on/off duration of said fuel-pressure control valve.

Preferably, the on/off timing and on/off duration of the fuel-pressure control valve is determined on the basis of injection timing, an amount of fuel injected, and a delay time of said fuel-pressure control valve. Further preferably, the engine operating conditions include at least one of engine speed and engine load, and the fuel pressure inside said fuel rail is detected by a pressure sensor mounted to said fuel rail. The fuel injection control method of the invention may further comprise determining if the engine is starting, and maintaining the fuel-pressure control valve closed for a predetermined duration if it is determined that the engine is starting.

In a further preferred embodiment, the method may be executed using a system comprising a high-pressure pump pump for pumping fuel, a fuel-pressure control valve disposed in a fuel bypass line communicating an output port of said high-pressure pump and an input port of said high-pressure pump, said fuel-pressure control valve selectively opening and closing said fuel bypass, and a controller for controlling said fuel-pressure control valve in order to regulate fuel pressure.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
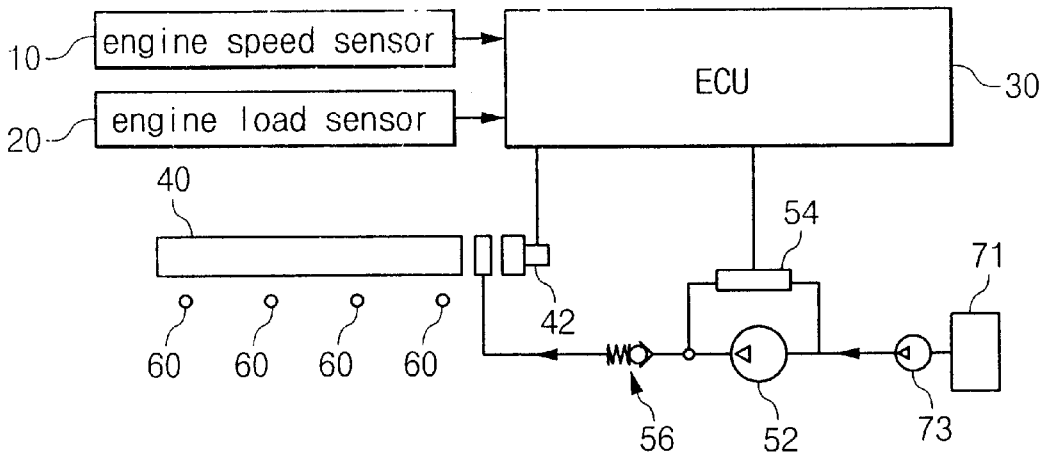
FIG. 1 is a schematic block diagram showing the fuel injection control system according to the preferred embodiment of the present invention.

As shown in FIG. 1, the fuel injection control system according to the preferred embodiment of the present invention comprises an engine speed sensor 10 for detecting an engine speed and an engine load sensor 20 for detecting an engine load. The engine load sensor 20 can preferably be an air flow sensor that detects an amount of air taken into an engine or an intake manifold pressure sensor that detects pressure of the intake manifold.

An engine control unit 30 (hereinafter referred to as an ECU) calculates an optimal fuel pressure based on engine speed and engine load detected by the engine speed sensor 10 and the engine load sensor 20. ECU 30 may comprise a CPU and memory or other processor, appropriately programmed by a person of ordinary skill in the art according to the teachings of the present invention.

A high-pressure pump 52 in the fuel line pressurizes fuel provided from a fuel tank 71 and provides the pressurized fuel into a fuel rail 40. A fuel-pressure control valve 54 is disposed in a fuel bypass line for bypassing some portion of fuel from an output port of the high-pressure pump 52 to an input port of the high-pressure pump 52. The fuel-pressure control valve 54 can preferably be an on/off solenoid valve. The fuel-pressure control valve 54 changes to an on or off state according to a control signal from the ECU 30.

If the fuel-pressure control valve 54 is on (open), some portion of the fuel of the high-pressure pump 52 is bypassed to the input port of the high-pressure pump 52 so that the pressure of the fuel output from the high-pressure pump 52 decreases. Consequently, power required for operating the high-pressure pump 52 becomes smaller.

On the other hand, if the fuel-pressure control valve 54 is off (closed), the fuel pressurized by the high-pressure pump 52 is provided into the fuel rail 40. That is, the fuel-pressure control valve 54 makes it possible to control the fuel pressure in the output port of the high-pressure pump 52 before the fuel pressurized by the high-pressure pump 52 is provided into the fuel rail 40 through a check valve 56.

A plurality of fuel injectors 60 are connected to the fuel rail 40 for providing fuel from the fuel rail 40 to each engine cylinder. In FIG. 1, four injectors are shown, but the number of the injectors may correspond to any number of cylinders. A pressure sensor 42 is disposed in the fuel rail 40 for detecting pressure of fuel inside the fuel rail 40. The fuel pressure detected by the pressure sensor 42 is provided to the ECU 30.

The ECU 30 compares the calculated optimal fuel pressure with the detected fuel pressure, and controls the fuel-pressure control valve 54 such that the actual fuel pressure approaches the optimal fuel pressure. For controlling the fuel pressure, the ECU 30 uses information on fuel injection timing and an amount of fuel injected because these factors have effects on the fuel pressure inside the fuel rail 40. The ECU 30 also considers the delay time of the fuel-pressure control valve so it can control the fuel pressure more precisely. The delay time of the fuel-pressure control valve is the time duration for the fuel-pressure control valve to affect the fuel pressure after receiving the signal from the ECU 30.

The ECU 30 determines on/off timing and on/off duration of the fuel-pressure control valve 54 on the basis of the fuel injection timing, an amount of fuel injected, and a delay time of the fuel-pressure control valve 54. The ECU 30 transmits a corresponding signal to the fuel-pressure control valve 54 for controlling the fuel-pressure control valve 54 on and off so that the fuel pressure can be controlled.

According to the on/off operation of the fuel-pressure control valve 54, an amount of fuel to be provided to the check valve 56 varies and thereby the on/off degree of the check valve 56 also varies. If the fuel-pressure control valve 54 opens, the opening degree of the check valve 56 becomes smaller and the fuel pressure of the output port of the high-pressure pump 52 decreases. To the contrary, if the fuel-pressure control valve 54 closes, the opening degree of the check valve 56 becomes larger and the fuel pressure of the output port of the high-pressure pump 52 increases.

Figure 2:
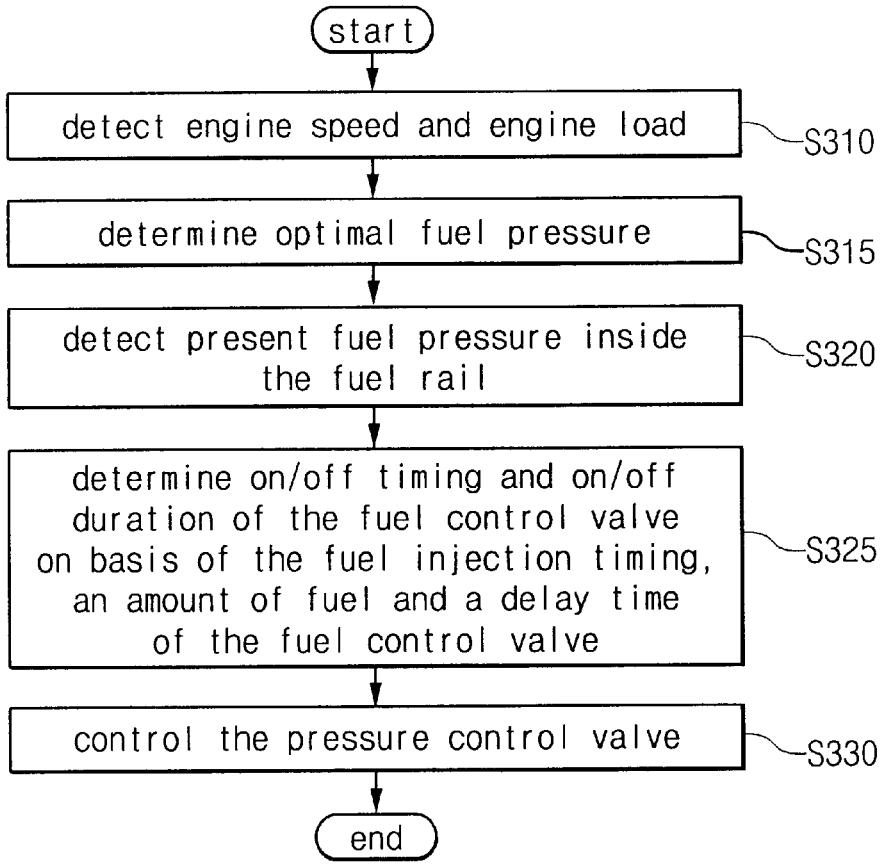
FIG. 2 is a flow chart showing the fuel injection control method according to the preferred embodiment of the present invention.
Figure 3:
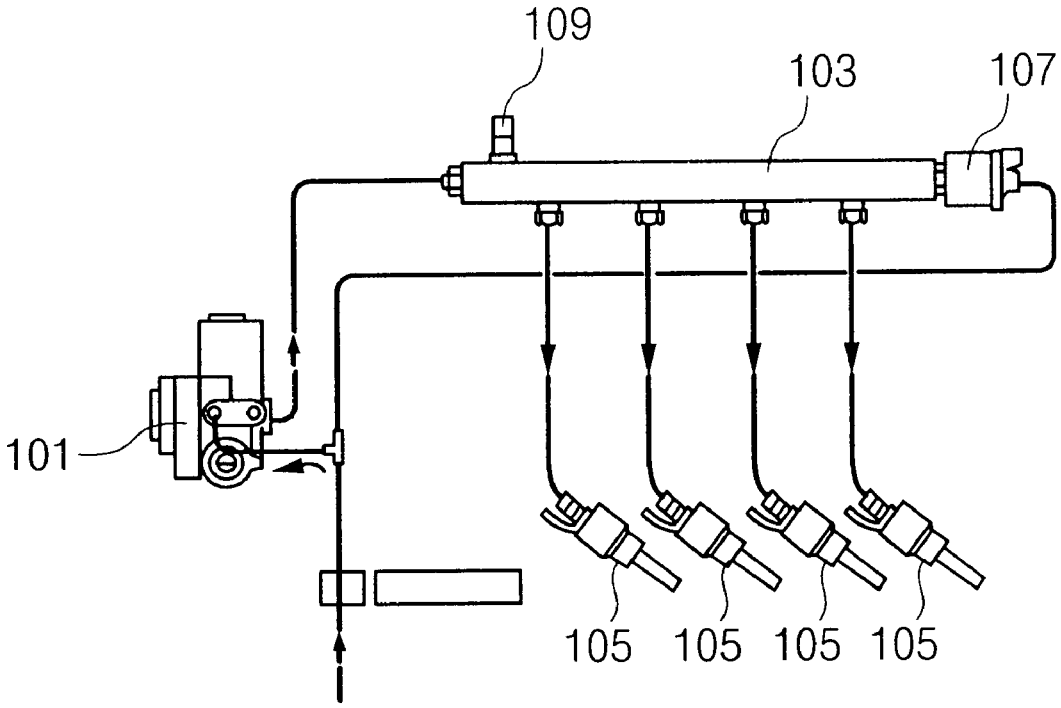
Fig. 3 (Prior Art)
FIG. 3 is a block diagram of the fuel injection control system according to the prior art.

Referring to FIG. 2, the fuel injection control method using the above fuel injection control system will be explained.

The ECU 30 determines the optimal fuel pressure on the basis of the engine speed and the engine load input from the engine speed sensor 10 and the engine load sensor 20 (S310 and S315). Preferably, the ECU 30 acquires the optimal fuel pressure under present engine speed and engine load from a map stored in the ECU memory. Then, the ECU 30 is provided with the present fuel pressure inside the fuel rail 40 from the pressure sensor 42 (S320).

The ECU 30 determines the on/off timing and the on/off duration of the fuel-pressure control valve 54 such that the actual fuel pressure approaches the optimal fuel pressure. This is determined on the basis of the fuel injection timing, an amount of fuel to be injected and a delay time of the fuel-pressure control valve 54. The ECU 40 transmits a corresponding signal to the fuel-pressure control valve 54 for controlling the fuel-pressure control valve 54 on and off so that the fuel pressure can be controlled (S325 and S330).

If the ECU 30 determines that the fuel pressure should be controlled to be decreased, the ECU 30 controls the fuel-pressure control valve 54 to be on. When the fuel-pressure control valve 54 opens, the opening degree of the check valve 56 becomes smaller and the fuel pressure of the output port of the high-pressure pump 52 decreases.

If the ECU 30 determines that the fuel pressure should be controlled to be increased, the ECU 30 controls the fuel-pressure control valve 54 to be off. When the fuel-pressure control valve 54 closes, the opening degree of the check valve 56 becomes larger and the fuel pressure of the output port of the high-pressure pump 52 increases.

Because the high-pressure pump 52 cannot sufficiently provide the fuel to the fuel rail 40 during engine start, the ECU 30 controls the fuel-pressure control valve 54 to be fully closed such that the fuel is provided to the high-pressure pump 52 by a low-pressure pump 73 that is mounted to the fuel tank 71 and thence to the fuel rail 40.

Here, if the engine speed is lower than a predetermined speed, the ECU 30 determines that the engine is starting. For an example, the predetermined engine speed can be set at about 50 rpm. When the ECU 30 determines that the engine is starting, the ECU 30 controls the fuel-pressure control valve 54 to be fully closed for a predetermined duration.

In the fuel injection control system according to the present invention, the fuel pressure of the output port of the high-pressure pump is controlled by returning some part of the fuel. Therefore, the fuel pump is prevented from being pressurized unnecessarily such that the engine loss for operating the fuel pump can be decreased.

What is claimed is:

1. A fuel injection control system, comprising:

a fuel rail to which a plurality of fuel injectors are connected;

a high-pressure pump disposed to provide pressurized fuel to the fuel rail;

(a check valve disposed between said high-pressure pump and said fuel rail, said check valve leading fuel to flow from the high-pressure pump to the fuel rail;

a fuel-pressure control valve disposed in a fuel bypass line communicating between an output port of said high-pressure pump and an input port of said high-pressure pump, said fuel-pressure control valve selectively opening and closing said fuel bypass line; and a controller for controlling an opening and closing operation of said fuel-pressure control valve on the basis of fuel injection timing, an amount of fuel injected, and a delay time of said fuel-pressure control valve such that fuel pressure inside said fuel rail approaches an optimal fuel pressure.

2. The system of claim 1, wherein said fuel pressure inside the fuel rail is detected by a pressure sensor that is mounted to said fuel rail.

3. The system of claim 1, wherein said optimal fuel pressure is calculated by said controller on the basis of engine speed and engine load.

4. A fuel injection control method, comprising:

monitoring engine operating conditions;

determining an optimal fuel injection pressure on the basis of said monitored engine operating conditions; and bypassing an amount of fuel from an output of a fuel pump to and input of the fuel pump such that fuel injection pressure generated by said pump approaches said optimal fuel injection pressure;

wherein a fuel pressure control valve regulates said bypassing and said bypassing comprises, using a system comprising a high-pressure pump for pumping fuel, a fuel-pressure control valve disposed in a fuel bypass line communicating between an output port and an input port of said high-pressure pump, said fuel-pressure control valve selectively opening and closing said fuel bypass line, and a controller for controlling said fuel-pressure control valve in order to regulate fuel pressure; and wherein on/off timing and on/off duration of said fuel-pressure control valve is determined on the basis of injection timing, an amount of fuel injected, and a delay time of said fuel-pressure control valve.

5. The method of claim 4, wherein said engine operating conditions includes at least one of engine speed and engine load.

6. The method of claim 4, wherein said fuel pressure inside said fuel rail is detected by a pressure sensor mounted to said fuel rail.

7. The method of claim 4, further comprising:

determining if an engine is starting; and maintaining said fuel-pressure control valve to be closed for a predetermined duration if it is determined that said engine is starting.

8. The method of claim 7, wherein said determining if an engine is starting is performed on the basis of engine speed.

9. The method of claim 4, wherein said method is performed using a system comprising a high-pressure pump for pumping fuel, a fuel-pressure control valve disposed in a fuel bypass line communicating between an output port and an input port of said high-pressure pump, said fuel-pressure control valve selectively opening and closing said fuel bypass line, and a controller for controlling said fuel-pressure control valve in order to regulate fuel pressure.

10. A fuel injection control system, comprising:

a fuel line adapted to provide pressurized fuel to a fuel rail supporting fuel injectors;

a fuel pump having an input and an output disposed in said fuel line;

a check valve disposed in said fuel line down stream from said pump;

a bypass line communicating between said pump output and input;

a fuel-pressure control valve disposed in said bypass line; and a control unit communicating with said fuel-pressure control valve, said control unit generating a signal for selectively opening or closing said fuel-pressure control valve based on fuel injection timing, an amount of fuel injected and a delay time of the fuel-pressure control valve such that fuel pressure inside the fuel rail approaches an optimal fuel pressure.

11. The system of claim 10, further comprising an engine speed sensor and an engine load sensor communicating with said control unit, wherein said control unit calculates the optimal fuel pressure based on input from said sensors.

* * * * *